US005605136A

United States Patent [19]

Nakashima

[11] Patent Number: 5,605,136

[45] Date of Patent: Feb. 25, 1997

[54] FUEL INJECTION CONTROL APPARATUS WITH INJECTOR RESPONSE DELAY COMPENSATION

[75] Inventor: Kazushi Nakashima, Nisshin, Japan

[73] Assignee: Nippondenso Co., Ltd., Kariya, Japan

[21] Appl. No.: 572,640

[22] Filed: Dec. 14, 1995

[30] Foreign Application Priority Data

Jan. 18, 1995 [JP] Japan ..... 7-005863

[51] Int. Cl.[6] ..... F02D 41/34

[52] U.S. Cl. ..... 123/480

[58] Field of Search ..... 123/478, 480, 123/486, 488, 494

[56] References Cited

U.S. PATENT DOCUMENTS 5,078,167 1/1992 Brandt et al. ..... 137/549

FOREIGN PATENT DOCUMENTS 61-190146 8/1986 Japan .

1-170739 7/1989 Japan .

6-346770 12/1994 Japan .

*Primary Examiner*—Andrew M. Dolinar

*Attorney, Agent, or Firm*—Cushman, Darby & Cushman IP Group of Pillsbury Madison & Sutro LLP

[57] ABSTRACT

A fuel injection control apparatus has a pressure regulator with a fuel return pipe installed within a fuel tank. The pressure regulator regulates pressure of fuel supplied to a fuel injector to be constant relative to an atmospheric pressure or an in-tank pressure. An electronic control unit drives the fuel injector by adding an invalid injection time to a required injection time determined based on engine operating conditions. The invalid injection time, which compensates for the response delays of the fuel injector, is determined by a battery voltage and a pressure difference between the fuel pressure and a selected pressure which is lower than the atmospheric pressure. The selected pressure may be a minimum pressure which an intake pressure of the engine becomes during fuel injection operation.

12 Claims, 6 Drawing Sheets

FIG. 7A
PRIOR ART
FIG. 7B
PRIOR ART
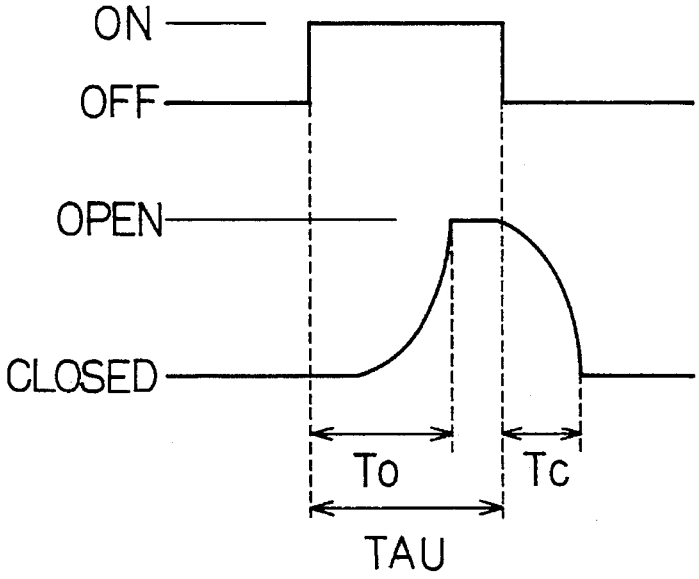
FIG. 8
PRIOR ART
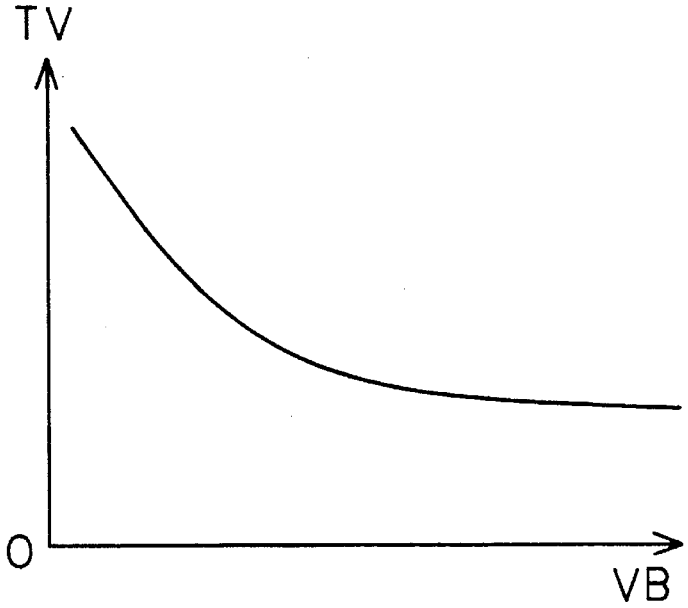

FUEL INJECTION CONTROL APPARATUS WITH INJECTOR RESPONSE DELAY COMPENSATION

CROSS REFERENCE TO RELATED APPLICATION

This application is based on and claims priority of Japanese Patent Application No. 7-5863 filed on Jan. 18, 1995, the content of which is incorporated herein by reference.

BACKGROUND OF THE INVENTION

1. Field of the Invention

The present invention relates to a fuel injection control apparatus for internal combustion engines and, more particularly, to a fuel injection control apparatus which injects an appropriate amount of fuel to an internal combustion engine by compensating for response delays of fuel injectors which vary with a battery voltage.

2. Description of Related Art

It is known generally in a fuel injection system for internal combustion engines that fuel injectors for injecting fuel into an engine have a response delay from the time point of receiving a driving voltage for starting fuel injection to the time point of actually opening a valve thereof for fuel injection. They also have another response delay from the time point of shutting off the driving voltage to the time point of actually closing the valve. These response characteristics are shown in FIGS. 7A and 7B. In FIG. 7B, time To represents the response delay of the injector from the time point of receiving the driving voltage of FIG. 7A to the time point of actual valve opening, while time Tc represents the response delay of the injector from the time point of shutting off of the driving voltage of FIG. 7A to the time point of actual valve closing. The response delay time To at the time of valve opening is longer than the response delay time Tc at the time of valve closing.

The injector does not inject fuel during the response delay time To at the time point of valve opening, while it continues to inject fuel during the response delay time Tc at the time point of valve closing. Thus, the actual fuel injection time does not coincide with a required fuel injection time TAU of the injector driving voltage calculated to correspond to a required fuel injection amount. Thus, there occurs a period during which time the injector does not inject fuel during the time TAU of the driving voltage. This time (TV=To−Tc) is referred to as an invalid injection time TV of the injector.

As disclosed in Japanese Patent Publication, Laid-open No. 1-170739, for instance, it is proposed to compensate for the response delays of the fuel injector by adding the invalid injection time TV to the calculated fuel injection time TAU. Because the invalid injection time TV varies with a battery voltage VB as shown in FIG. 8, the invalid injection time TV increases in accordance with a decrease in the battery voltage VB.

Further, the fuel injection system has a pressure regulator which returns excess fuel to a fuel tank when a pressure of fuel PF pressurized and supplied from a fuel pump becomes higher than an intake pressure PM of the engine by a predetermined pressure value. Thus, the pressure difference ΔP between the intake pressure PM and the fuel pressure PF may be maintained constant even when the intake pressure PM varies depending on engine operating conditions. The pressure difference ΔP between the fuel pressure PF and the intake pressure PM is maintained constant at a pressure difference ΔPS, which is equal to the fuel pressure PS set in correspondence with the atmospheric pressure PA, as shown in FIG. 9A. In this instance, since the invalid injection time TV varies only with the battery voltage VB, the injection time may be compensated with high accuracy by determining the invalid injection time TV in accordance with the battery voltage VB and adding the same to the injection time TAU.

This pressure regulator, however, necessitates a return pipe which returns the excess fuel to the fuel tank. The return pipe needs to be extended from an engine compartment, which is normally in the front part of an automotive vehicle, to the rear part of the vehicle where the fuel tank is normally provided, thus complicating the arrangement of the return pipe.

It has been proposed to install the pressure regulator within the fuel tank or in the vicinity thereof to shorten the length of the return pipe and to regulate the fuel pressure PF relative to the pressure in the fuel tank or the atmospheric pressure PA as shown in FIG. 9B.

As understood from FIG. 9B, the pressure difference ΔP between the fuel pressure PF and the intake pressure PM becomes large as the intake pressure PM becomes low towards a vacuum side, although it does not differ much from the set fuel pressure PS as long as the intake pressure PM is around the atmospheric pressure PA. In this instance, the invalid injection time TV will vary not only with the battery voltage VB but also with the pressure difference ΔP. That is, the invalid injection time TV becomes longer as the pressure difference ΔP between the upstream and downstream of the injector becomes larger, because the larger pressure difference exerts a force on the valve of the injector and causes a larger valve opening response delay. Thus, determining the invalid injection time TV in accordance with only the battery voltage VB under the condition that the fuel pressure PF is set in correspondence with the atmospheric pressure and adding the same to the calculated injection time TAU cannot compensate for the response delays correctly. In this case, the air-fuel ratio of air-fuel mixture supplied to the engine deviates to a fuel-lean side, resulting in a decrease in engine output torque and an increase in NOx (nitrogen oxides) in the exhaust gas.

SUMMARY OF THE INVENTION

It is therefore an object of the present invention to provide a fuel injection control apapratus which suppresses deviation of an air-fuel ratio of an air-fuel mixture to fuel-lean side even when a pressure difference between a fuel pressure and an intake pressure changes a great deal.

It is a further object of the present invention to provide a fuel injection apparatus which compensates for response delay times of an injector used with a pressure regulator which regulates a fuel pressure to be constant relative to the atmospheric pressure or a pressure within a fuel tank.

According to the present invention, a pressure regulator is constructed to regulate a pressure of fuel to be supplied to a fuel injector to be constant relative to a predetermined pressure which is not influenced by changes in an intake pressure of an engine. The fuel injector is driven during a time determined by adding an invalid injection time of the injector and a required fuel injection time determined based on operating conditions of the engine. The invalid injection time which compensates for the response delay of the injector is determined by a battery voltage and also by a pressure difference between the fuel pressure and a selected pressure lower than the atmospheric pressure.

Preferably, the predetermined pressure is one of the atmospheric pressure and a pressure within a fuel tank, and the selected pressure is one of a vacuum pressure and a minimum pressure which an intake pressure of the engine may take during engine operation, fuel injection operation, engine idling operation, etc.

More preferably, a data map defining the invalid injection time relative to the battery voltage is stored in a memory so that it may be retrieved from time to time in accordance with the battery voltage.

BRIEF DESCRIPTION OF THE DRAWINGS

In the accompanying drawings:

FIGS. 7A and 7B are time charts respectively showing a driving voltage for injectors and operation of the injectors according to a conventional fuel injection control apparatus;

FIG. 8 is a graph showing an invalid injection time relative to a battery voltage according to the prior art.

DETAILED DESCRIPTION OF THE PREFERRED EMBODIMENTS

The present invention will be described in more detail with reference to an embodiment of a fuel injection control apparatus according to the present invention.

Figure 1:
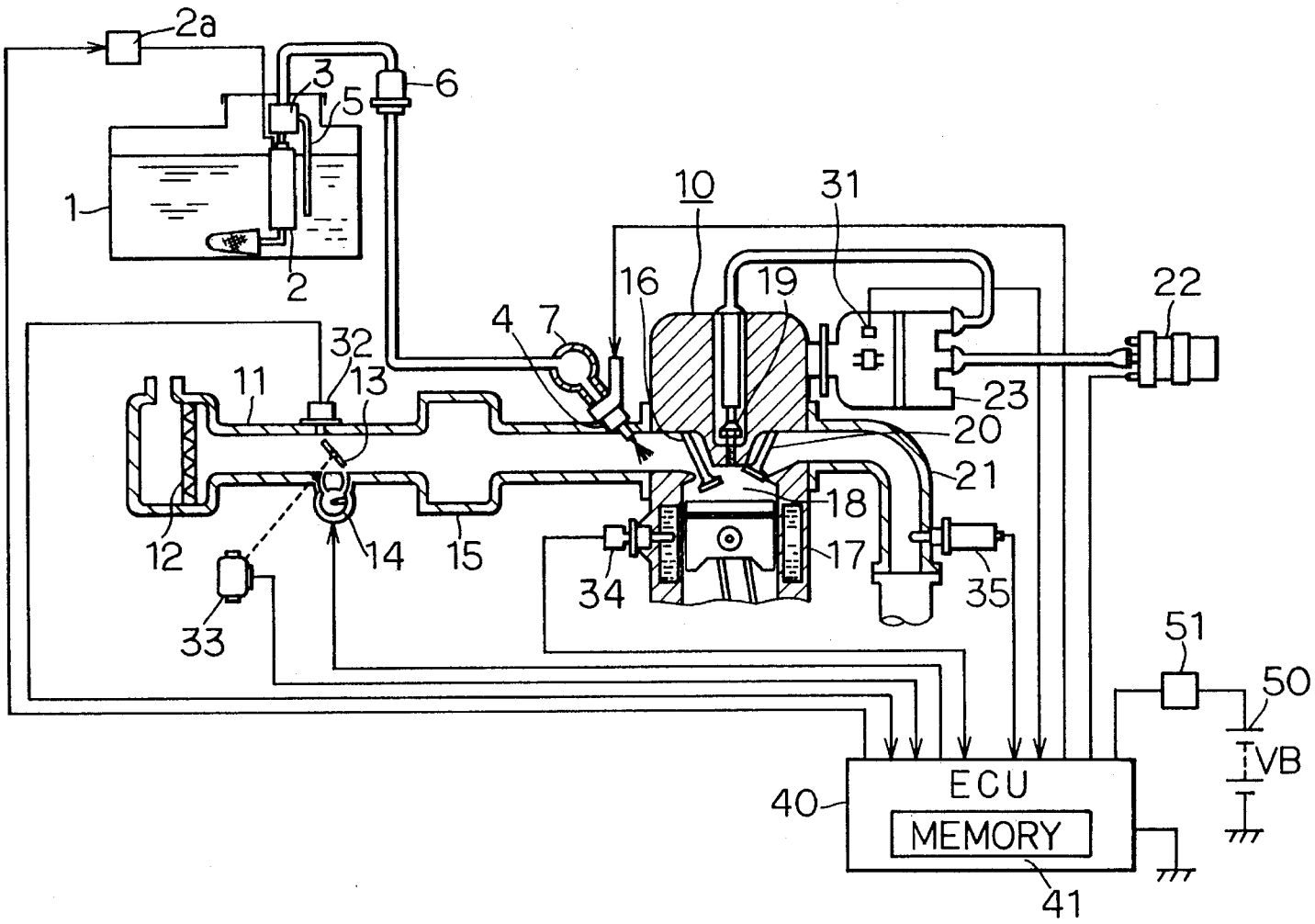
FIG. 1 is a schematic view of an embodiment of a fuel injection control apparatus according to the present invention.

The fuel injection control apparatus shown in FIG. 1 is constructed to regulate fuel pressure constant relative to the atmospheric pressure or a pressure in a fuel tank and to compensate fuel injection time or fuel injection amount by appropriately determining an invalid injection time of a fuel injector.

As shown in FIG. 1, a fuel tank 1 is provided therein with a fuel pump 2 connected to a pressure regulator 3. The fuel pump 2 pressurizes the fuel within the tank 1 and feeds the pressurized fuel to the regulator 3.

Figure 9A:
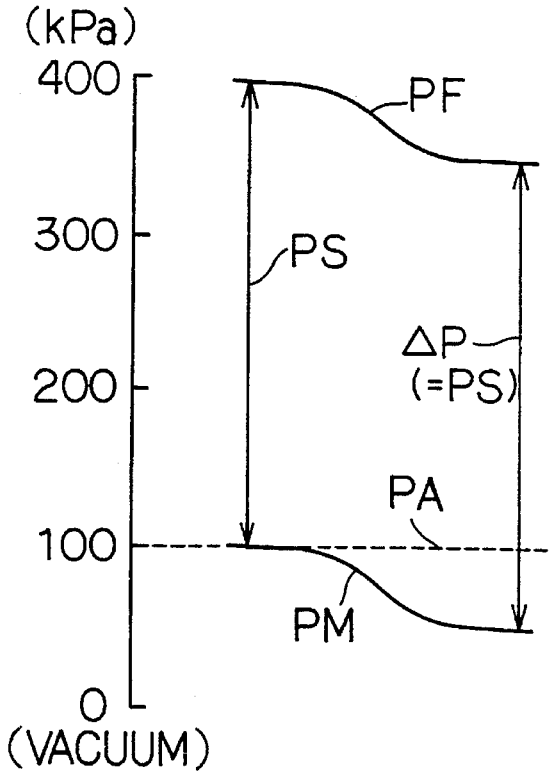
FIG. 9A PRIOR ART
FIGS. 9A and 9B are graphs respectively showing characteristics of fuel pressure relative to an intake pressure in the conventional fuel injection control apparatus.
Figure 9B:
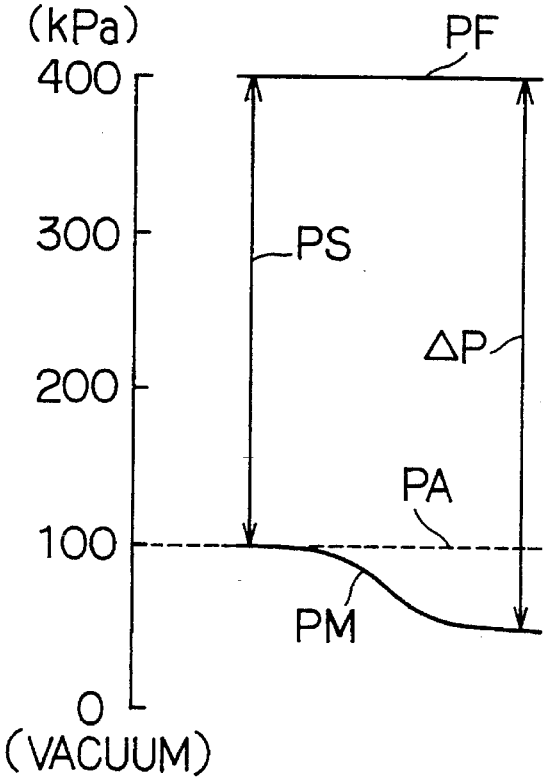
FIG. 9B PRIOR ART

The pressure regulator 3 regulates the pressure of fuel supplied to a fuel injector 4 mounted on the intake manifold of an internal combustion engine 10, so that the fuel pressure PF is maintained constant relative to the pressure in the air (atmospheric pressure PA) or the pressure within the fuel tank 1 (in-tank pressure). This fuel pressure regulating characteristic of the pressure regulator 3 is shown in FIG. 9B. When the pressure of the pressurized fuel from the fuel pump 2 rises above the set fuel pressure PS, the pressure regulator 3 returns excess fuel into the tank 1 through a return pipe 5.

The fuel pressure-regulated to the constant value, e.g., 400 kPa (kilo Pascals), is supplied from the pressure regulator 3 to a delivery pipe 7 through a fuel filter 6 so that the delivery pipe 7 distributes the pressure-regulated fuel to each injector 4. Each injector 4 injects the fuel into the intake manifold of the engine 10 by opening a valve thereof during a time period of a driving voltage applied from an electronic control unit (ECU) 40.

The fuel injected by the injector 4 mixes with air supplied through an air cleaner 12, a throttle valve 13, an idling speed control (ISC) valve 14 and a surge tank 15 of an intake pipe 11 to form an air-fuel mixture which is supplied to a combustion chamber 18 of each cylinder 17 of the engine 10.

As is well known, the throttle valve 13 is linked with an accelerator pedal of a motor vehicle and controls the amount of air supplied through the intake pipe 11 to be mixed with the injected fuel, while the ISC valve 14 controls the amount of air bypassing the throttle valve 13 for controlling a rotational speed of the engine 10 during engine idling condition. The surge tank 15 is provided for suppressing pressure fluctuations of intake air supplied through the throttle valve 13 and the ISC valve 14.

The air-fuel mixture thus supplied into the combustion chamber 18 is compressed by a piston and ignited by an ignition spark generated by a spark plug 19. The engine produces rotation torque by the combustion of the mixture. After combustion of the mixture, the resultant gas is dischaged as exhaust gas into an exhaust pipe 21 through an exhaust valve 20. An ignition coil 22 which generates a high ignition voltage is connected to a distributor 23 which distributes the high ignition voltage to each spark plug 19.

The fuel injection control is performed by the ECU 40 based on operating conditions of the engine 10 detected by various sensors. A rotation sensor 31 is provided in the distributor 23 to detect the rotation position of the engine 10. An intake pressure sensor 32 is provided on the intake pipe 11 to detect an intake pressure PM in the intake pipe 11, and a throttle sensor 33 is coupled with the throttle valve to detect the opening degree of the throttle valve 13. A coolant temperature sensor 34 is mounted on the engine 10 to detect temperature of the coolant. An oxygen ($O_2$) sensor 35 is mounted on the exhaust pipe 21 to detect oxygen concentration in the exhaust gas.

The ECU 40 which is connected to those sensors includes a central processing unit (CPU, not shown), a memory 41 and various associated circuits (not shown). The ECU 40, receiving signals from the sensors indicative of the engine conditions, calculates the required fuel injection time TAU for driving the fuel injector 4, ISC valve 14 and the ignition coil 22. The ECU 40 is connected to a storage battery 50 via a relay 51 and monitors a battery voltage VB to determine the invalid injection time TV of the injector 4 based on the monitored battery voltage VB and correct the required injection time TAU.

Figure 2:
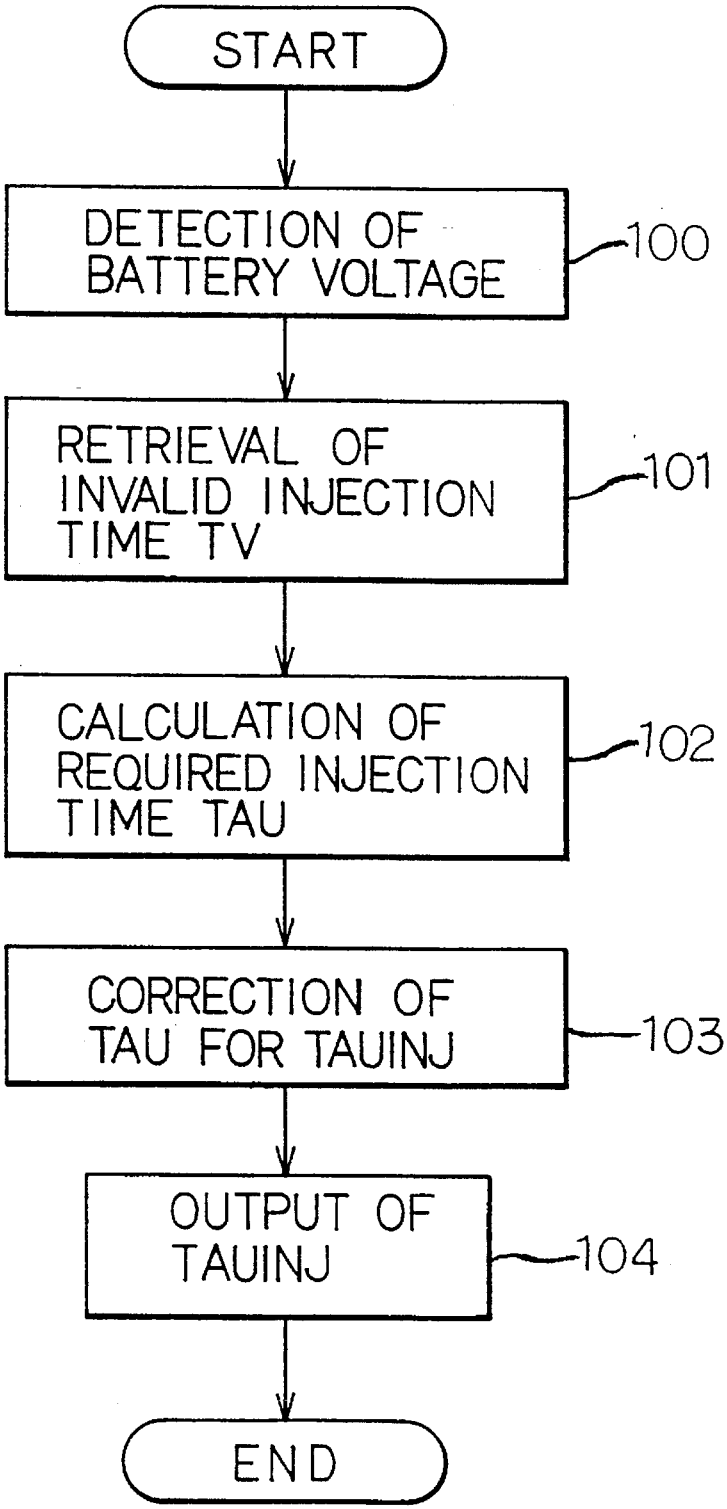
FIG. 2 is a flow chart showing a fuel injection control process performed in the embodiment shown in FIG. 1.

The ECU 40 performs the fuel injection control based on a programmed control process shown in FIG. 2, using the data map of the invalid injection time TV relative to the battery voltage VB. The invalid injection time TV may be determined experimentally as shown in FIG. 3 and stored in the memory 41.

Figure 3:
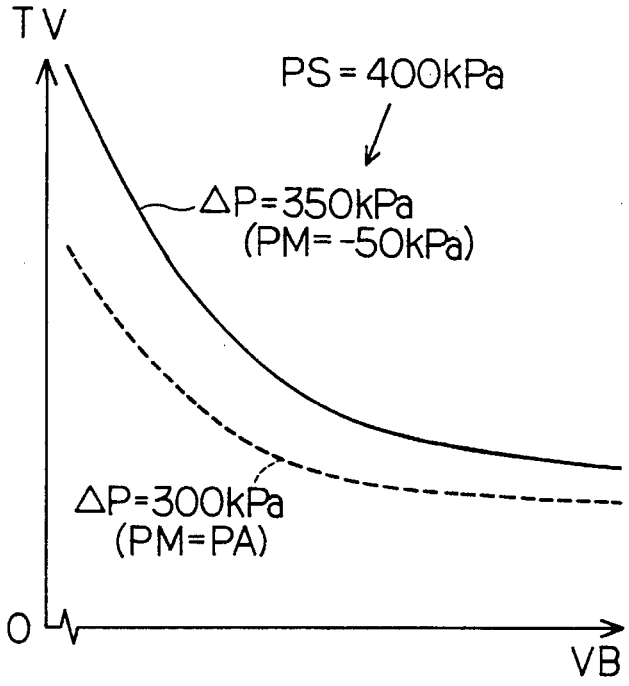
FIG. 3 is a graph showing an invalid injection time relative to a battery voltage, the graph characteristics being used in the control process shown in FIG. 2.

In the fuel control process shown in FIG. 2, the ECU 40 first detects at a step 100 the battery voltage VB of the battery 50 and then, based on the detected battery voltage VB, determines the invalid injection time TV by retrieving the map data from the data map of FIG. 3.

As shown by a solid line in FIG. 3, the invalid injection time TV is stored in relation to the battery voltage VB under the condition that the pressure difference ΔP between the intake pressure PM and the set fuel pressure PS becomes 350 kPa in the case of the intake pressure PM being at −50 kPa relative to the atmospheric pressure, i.e., the engine 10 being operated in the idling condition with the fully-closed throttle valve 13. It is to be noted that the relation between the set fuel pressure PS of 400 kPs and the pressure difference ΔP corresponds to the relation of the same which occurs in the case of the maximum pressure difference ΔP in FIG. 9B.

The characteristic of the invalid injection time TV relative to the battery voltage VB in the conventional apparatus is also shown by a dotted line in FIG. 3 for the purpose of comparison with the present invention. In this case, the pressure difference ΔP is set to 300 kPa which is the difference between the set fuel pressure PS of 400 kPa and the intake pressure PM when it is the same as the atmospheric pressure of 100 kPa. This relation is the same as the relation shown in FIG. 9A.

The ECU 40, thus having determined thus the invalid injection time TV, calculates at a step 102 the required injection time TAU corresponding to a required fuel injection amount. It is known that the required fuel injection time TAU corresponding to the required amount is calculated as follows:

(1) The rotational speed NE of the engine 10 is calculated from the output signals of the rotation sensor 31.

(2) A basic fuel injection time TP is calculated from the rotational speed NE and the intake pressure PM, by retrieving TP from a data map defining a relation among TP, NE and PM. The data map may be determined experimentally and stored in the memory 41.

(3) The basic fuel injection time TP is corrected by other engine conditions, such as acceleration/deceleration of the engine 10 and coolant temperature of the engine 10, which are detected by the throttle sensor 33 and the coolant temperature sensor 34, respectively.

(4) In the case of air-fuel ratio feedback being performed for air-fuel ratio control, the required fuel injection time TAU is corrected further by the oxygen concentration in the exhaust gas detected by the oxygen sensor 35.

The ECU 40 corrects the required injection time TAU by adding the invalid injection time TV thereto at a step 103, thus determining the final fuel injection time TAUINJ as TAUINJ=TAU+TV. The ECU 40 applies the driving voltage as the fuel injection pulse having the time TAUINJ to the injector 4 at the following step 104, which responsively opens the valve thereof for injecting the pressure-regulated fuel to the engine 10 during the period of time TAU. It is to be noted that the above-described control process is repeated at every predetermined interval and the driving of the injector 4 is timed in relation to the rotational position of the engine 10. Thus, it is ensured that the injector 4 delivers required fuel injection amount even if it has the response delays.

Figure 4:
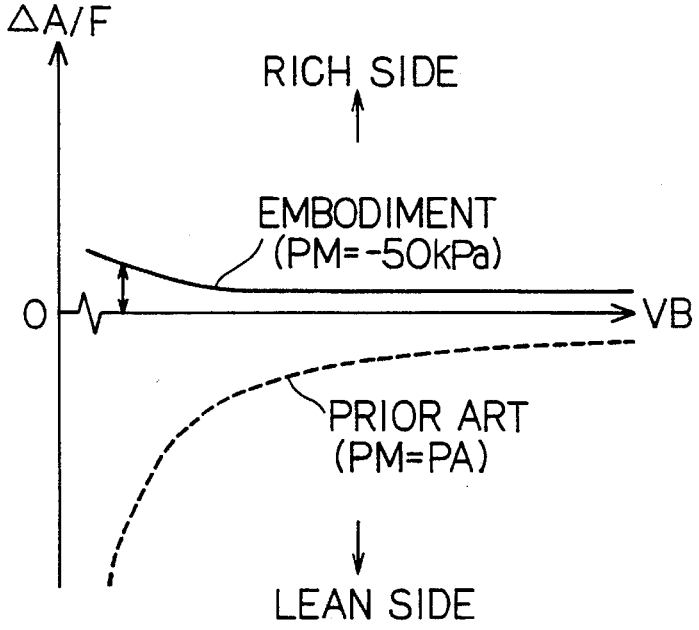
FIG. 4 is a graph showing a deviation of an air-fuel ratio relative to a battery voltage, the deviation resulting from use of the graph characteristics shown in FIG. 3 in the embodiment.

According to the fuel injection control described hereabove, the invalid injection time TV (solid line in FIG. 3) is determined to be a little longer than that in the conventional fuel injection control (dotted line in FIG. 3). In this case, because the invalid injection time TV is set in correspondence with the engine idling condition in which the throttle valve 13 is closed fully and the pressure difference ΔP becomes the maximum, the deviation of the air-fuel ratio ΔA/F is reduced to about ±0 as long as the engine 10 is in or near the idling condition. It is most likely that the deviation of air-fuel ratio ΔA/F becomes the largest when the throttle valve 13 is opened fully (PM=100 kPa). Even in this case, however, although the deviation of air-fuel ratio ΔA/F from the stoichiometric air-fuel ratio moves slightly to the fuel-rich side as shown by a solid line in FIG. 4, it does not cause the deviation in the fuel-lean side. In FIG. 4, a dotted line shows a characteristics of the deviation of air-fuel ratio ΔA/F which will be caused largely in the fuel-lean side in the case that the invalid injection time TV shown by the dotted line in FIG. 3 is used in the step 102 of the above-described embodiment. Since the deviation of the air-fuel ratio ΔA/F is not caused in the fuel-lean side, neither the reduction in the rotational torque of the engine 10 nor the increase in the NOx in the exhaust gas is caused.

Although in the embodiment the invalid injection time TV is set based on the pressure difference ΔP between the fuel pressure PF and the intake pressure PM at the time of the engine idling condition, it may be set alternatively in the following manners as modifications (A) through (D).

(A) The invalid injection time TV relative to the battery voltage VB may be set to correspond to the pressure difference ΔP between the fuel_pressure PF and the minimum value of the intake pressure PM which may occur during the fuel injection to the engine 10. Here, the minimum value of the intake pressure PM may occur when the engine is in the deceleration condition for vehicle deceleration just before the fuel injection is shut off.

Figure 5:
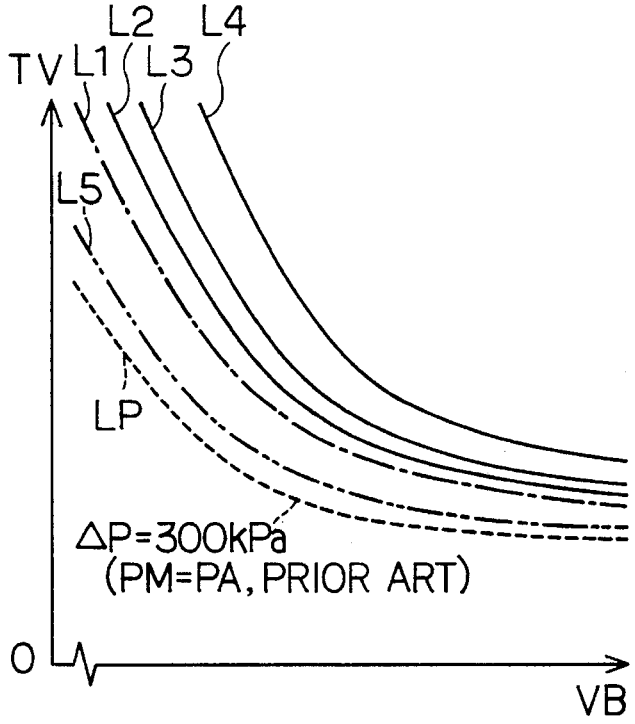
FIG. 5 is a graph showing other invalid injection time data relative to a battery voltage, the graph being used as an alternative to the graph characteristics shown in FIG. 3.

This invalid injection time TV is shown by a solid line L2 in FIG. 5 in comparison with the invalid injection time TV in the above-described embodiment (L1, a dot-and-chain line ) and in the conventional apparatus (LP, a dotted line ). In this instance, the invalid injection time TV of the line L2 is set to correspond to the slightly lower intake pressure PM, i.e., slightly larger pressure difference ΔP, than in the above-described embodiment and it becomes slightly larger than that of the line L1 relative to the same battery voltage VB.

Figure 6:
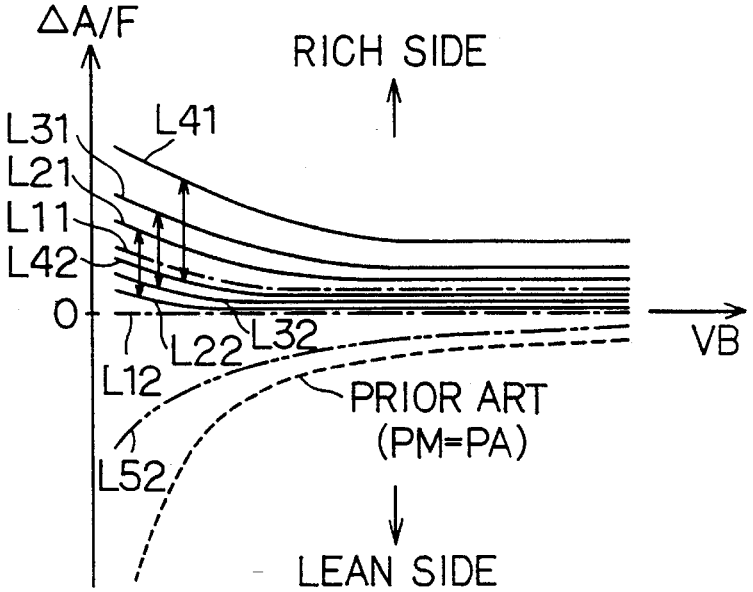
FIG. 6 is a graph showing a deviation of an air-fuel ratio relative to a battery voltage, the deviation resulting from use of the graph characteristics shown in FIG. 5.

In this instance, the deviation of the air-fuel ratio ΔA/F from the stoichiometric air-fuel ratio results in a range defined by lines L21 and L22 in FIG. 6. This deviation is not in the fuel-lean side but in the fuel-rich side, and therefore reduction in the engine torque and the increase in NOx are effectively avoided.

(B) The invalid injection time TV relative to the battery voltage VB may be set to correspond to the pressure difference ΔP between the fuel pressure PF and the minimum value of the intake pressure PM which may occur during engine operation. The minimum value of the intake pressure PM may occur when the engine is in deceleration for the vehicle deceleration and the fuel injection is shut off.

This invalid injection time TV is shown by a solid line L3 in FIG. 5. In this instance, the invalid injection time TV of the line L3 is set to correspond to the further slightly lower intake pressure PM, i.e., further slightly larger pressure difference ΔP, than in the case of the modification (A) and it becomes slightly larger than that of the line L2 relative to the same battery voltage VB.

In this instance, the deviation of the air-fuel ratio ΔA/F results in a range defined by lines L31 and L32 in FIG. 6. This deviation is not in the fuel-lean side but in the more fuel-rich side than in the modification (A), and therefore the reduction in the engine torque and the increase in NOx are effectively avoided as in the case of the modification (A).

(C) The invalid injection time TV relative to the battery voltage VB may be set to correspond to the pressure difference ΔP between the fuel pressure PF and the intake pressure PM which is assumed to be the vacuum.

This invalid injection time TV is shown by a solid line L4 in FIG. 5. In this instance, the invalid injection time TV of the line L4 is set to correspond to the further lower intake pressure PM, i.e., further larger pressure difference ΔP, than in the case of the modification (B) and it becomes larger than that of the line L3 relative to the same battery voltage VB.

In this instance, the deviation of the air-fuel ratio ΔA/F results in a range defined by lines L41 and L42 in FIG. 6. This deviation is not in the fuel-lean side but in the more fuel-rich side than in the modification (B), and therefore reduction in the engine torque and the increase in NOx are effectively avoided as in the case of the modification (B).

(D) The invalid injection time TV relative to the battery voltage VB may be set to correspond to the pressure difference ΔP between the fuel pressure PF and the intake pressure PM which is at a selected value below the atmospheric pressure but closer to the atmospheric pressure than in the modification (A).

This invalid injection time TV is shown by a two-dot-and-chain line L5 in FIG. 5. In this instance, the invalid injection time TV of the line L5 is set larger than LP of the conventional apparatus.

In this instance, the deviation of the air-fuel ratio ΔA/F results in a range defined by a line L52 as the most fuel-lean limit in FIG. 6. Although this deviation may also cover the fuel-lean side, the range of deviation is restricted more to the fuel-rich side than in the conventional apparatus. As a result, the reduction in the engine torque and the increase in NOx are restricted more than in the conventional apparatus.

In the above-described embodiment and its alternative modifications (A) through (D), the invalid injection time TV relative to the battery voltage VB is determined by the use of the graphs shown in FIGS. 3 and 5 and, hence, the fuel injection control logic or control program need not be changed so much from the conventional one. It may be determined, however, by mathematical calculations using functions defining such relations as shown in FIGS. 3 and 5.

Further, the installation location of the pressure regulator 3 is not limited to the interior of the fuel pump 1. As long as the pressure regulator 3 regulates the fuel pressure constant relative to the atmospheric pressure or the in-tank pressure, i.e., independently of the intake pressure, it may be located outside the fuel tank 1.

Still further, the present invention having been described in detail should not be limited to the disclosed embodiment and modifications but may be modified in other ways without departing from the spirit of the invention.

What is claimed is:

1. A fuel injection control apparatus comprising:

a fuel injector mounted on an engine to inject fuel into said engine when driven by a battery;

a pressure regulator operatively connected to said fuel injector to regulate a pressure of said fuel constant relative to a predetermined pressure which is independent of an intake pressure of said engine;

means for determining a required fuel injection time of said fuel injector based on operating conditions of said engine;

means for determining an invalid injection time of said fuel injector based on a voltage of said battery and a pressure difference between said pressure of said fuel and a selected pressure which is lower than an atmospheric pressure;

means for compensating said required fuel injection time by adding said invalid injection time to determine a final injection time; and means for driving said fuel injector by said battery during said final injection time, wherein said selected pressure is a minimum pressure which said intake pressure becomes during operation of said engine.

2. A fuel injection control apparatus according to claim 1, wherein said invalid injection time determining means has a memory storing therein said invalid injection time relative to said voltage of said battery.

3. A fuel injection control apparatus according to claim 1, wherein said predetermined pressure is one of an atmospheric pressure and a pressure within a fuel tank.

4. A fuel injection control apparatus comprising:

a fuel injector mounted on an engine to inject fuel into said engine when driven by a battery;

a pressure regulator operatively connected to said fuel injector to regulate a pressure of said fuel constant relative to a predetermined pressure which is independent of an intake pressure of said engine;

means for determining a required fuel injection time of said fuel injector based on operating conditions of said engine;

means for determining an invalid injection time of said fuel injector based on a voltage of said battery and a pressure difference between said pressure of said fuel and a selected pressure which is lower than an atmospheric pressure;

means for compensating said required fuel injection time by adding said invalid injection time to determine a final injection time; and means for driving said fuel injector by said battery during said final injection time, wherein said selected pressure is a minimum pressure which said intake pressure becomes during fuel injection of said fuel injector.

5. A fuel injection control apparatus according to claim 4, wherein said predetermined pressure is one of an atmospheric pressure and a pressure within a fuel tank.

6. A fuel injection control apparatus comprising:

a fuel injector mounted on an engine to inject fuel into said engine when driven by a battery;

a pressure regulator operatively connected to said fuel injector to regulate a pressure of said fuel constant relative to a predetermined pressure which is independent of an intake pressure of said engine;

means for determining a required fuel injection time of said fuel injector based on operating conditions of said engine;

means for determining an invalid injection time of said fuel injector based on a voltage of said battery and a pressure difference between said pressure of said fuel and a selected pressure which is lower than an atmospheric pressure;

means for compensating said required fuel injection time by adding said invalid injection time to determine a final injection time; and means for driving said fuel injector by said battery during said final injection time, wherein said selected pressure is a minimum pressure which said intake pressure becomes during fuel injection by said fuel injector in an idling operation of said engine.

7. A fuel injection control apparatus according to claim 6, wherein said predetermined pressure is one of an atmospheric pressure and a pressure within a fuel tank.

8. A fuel injection control apparatus comprising:

a fuel injector mounted on an engine to inject fuel into said engine when driven by a battery;

a pressure regulator operatively connected to said fuel injector to regulate a pressure of said fuel constant relative to a predetermined pressure which is independent of an intake pressure of said engine;

means for determining a required fuel injection time of said fuel injector based on operating conditions of said engine;

means for determining an invalid injection time of said fuel injector based on a voltage of said battery and a pressure difference between said pressure of said fuel and a selected pressure which is lower than an atmospheric pressure;

means for compensating said required fuel injection time by adding said invalid injection time to determine a final injection time; and means for driving said fuel injector by said battery during said final injection time, wherein said selected pressure is determined to prevent an air-fuel ratio of an air-fuel mixture to said engine from deviating to a fuel-lean side relative to a stoichiometric air-fuel ratio even when said intake pressure changes.

9. A fuel injection control apparatus according to claim 8, wherein said predetermined pressure is one of an atmospheric pressure and a pressure within a fuel tank.

10. A fuel injection control apparatus comprising:

a fuel injector mounted on an engine to inject fuel into said engine when driven by a battery;

a pressure regulator operatively connected to said fuel injector to regulate a pressure of said fuel constant relative to a predetermined pressure which is independent of an intake pressure of said engine;

means for determining a required fuel injection time of said fuel injector based on operating conditions of said engine;

means for determining an invalid injection time of said fuel injector based on a voltage of said battery and a pressure difference between said pressure of said fuel and a selected pressure which is lower than an atmospheric pressure;

means for compensating said required fuel injection time by adding said invalid injection time to determine a final injection time; and means for driving said fuel injector by said battery during said final injection time, wherein said selected pressure is determined to prevent an air-fuel ratio of air-fuel mixture to said engine from deviating to a fuel-lean side relative to a stoichiometric air-fuel ratio in at least an idling condition of said engine.

11. A fuel injection control apparatus according to claim 10, wherein said predetermined pressure is one of an atmospheric pressure and a pressure within a fuel tank.

12. A fuel injection control apparatus comprising:

a fuel injector mounted on an engine to inject fuel into said engine when driven by a battery;

a pressure regulator operatively connected to said fuel injector to regulate a pressure of said fuel so that it is unchanged by an intake pressure of said engine; and an electronic control unit programmed to perform the processes of, determining a required fuel injection time of said fuel injector based on operating conditions of said engine, determining an invalid injection time of said fuel injector based on a voltage of said battery and a pressure difference between said pressure of said fuel and a selected pressure which is produced when a throttle valve of said engine is in a closed condition, compensating said required fuel injection time by adding said invalid injection time to determine a final injection time, and driving said fuel injector by said battery during said final injection time, wherein said invalid injector time has a value effective to avoid a fuel-lean condition of an air-fuel mixture relative to a stoichiometric air-fuel ratio.

* * * * *